United States Patent [19]

Hopkins

[11] 4,173,439

[45] Nov. 6, 1979

[54] APPARATUS HAVING EXPANDING AND CONTRACTING CHAMBER

[76] Inventor: Walter M. Hopkins, 1306 W. Glenoaks Blvd., Glendale, Calif. 91201

[21] Appl. No.: 855,294

[22] Filed: Nov. 28, 1977

[51] Int. Cl.[2] ..... F01C 1/02; F01C 11/00; F03C 3/00

[52] U.S. Cl. ..... 418/58; 418/63; 418/208; 418/209

[58] Field of Search ..... 418/57, 58, 59, 63, 418/196, 208, 209; 251/212

[56] References Cited

U.S. PATENT DOCUMENTS

| | | | |
|---|---|---|---|
| 1,349,882 | 8/1920 | Homan | 418/196 |
| 2,097,881 | 11/1937 | Hopkins | 418/196 |
| 3,324,839 | 6/1967 | Erwin | 418/58 |
| 3,809,026 | 5/1974 | Snyder | 418/196 |

FOREIGN PATENT DOCUMENTS

| | | | |
|---|---|---|---|
| 18726 | 9/1928 | Netherlands | 418/58 |

*Primary Examiner*—John J. Vrablik
*Attorney, Agent, or Firm*—John E. Wagner

[57] ABSTRACT

An apparatus having at least one alternately expanding and contracting chamber comprises a plurality of cylindrical rollers each having an exterior surface in continuous rolling engagement with two adjacent rollers, the rollers being rotatable along parallel axes, with at least one of the rollers rotating about an eccentric and/or reciprocating axis. The rollers are preferably of equal length with adjacent rollers being in contact substantially along their entire respective lengths, the chamber being defined between the rollers and enclosed at its ends by end plates.

14 Claims, 10 Drawing Figures

APPARATUS HAVING EXPANDING AND CONTRACTING CHAMBER

BACKGROUND OF THE INVENTION

Alternately expanding and contracting chambers are well known in the art, which devices employ various forms of rings or sliding surfaces to achieve sealing between adjacent parts. Commonly known is the piston-type combustion engine employing a closed cylinder, in which a piston, driven by a crankshaft and connecting rod, provides an alternately expanding and contracting chamber. Similarly, the well-known Wankel engine utilizes scraping edge seals between the rotating piston and chamber inner surfaces by which the gases are compressed and expanded. Obviously, such apparatus result in substantial friction between the contacting components thereby causing wear.

In an attempt to avoid these continually wearing seals or rings between moving parts, rotary engines have been proposed in U.S. Pat. Nos. 1,349,882 and 2,097,881. The earlier patent employs four elliptical piston between which the narrow spaces are sealed by spring-actuated rollers. In the latter patent, four elliptical rollers are in contact to define a combustion chamber therebetween. The problem with the aforesaid designs is their limitation because of the number of pistons or rollers as well as their shapes. Precise synchronization is required between the rotating and non-cylindrical rotors or pistons which is a significant disadvantage in apparatus design, as well as limiting the compression ratio of the chamber.

CROSS REFERENCE TO RELATED APPLICATIONS

Reference is made to my copending applications for related inventions Ser. No. 816,320, filed July 18, 1977 now U.S. Pat. No. 4,139,336 and Ser. No. 855,208, filed Nov. 28, 1977.

SUMMARY OF THE INVENTION

The apparatus of the present invention utilizes rotating cylindrical members or rollers, adjacent ones of which are maintained in continuous rolling contact. This contact between the rollers, which is continuous and held firmly, and preferably substantially along the entire roller lengths, obviates the necessity of seals and at the same time minimizes friction wear, thus, greatly increasing the longevity of the apparatus and reducing the incidence of repairs. The preferred apparatus incorporates an even number of rollers, preferably at least six. A fewer number of rollers can not achieve full continuous rolling contact without some slippage, resulting in friction and uneven wear of the roller surfaces. The present apparatus provides at least one alternately expanding and contracting chamber sealed and defined between the rollers. The cavity may be used for gases, liquids or slurries. Thus, use of such apparatus may be for engines, pumps, motors, compressors and other energy transfer devices and the like. The apparatus is not only a significant improvement because of its relative simplicity of design and reduction in operating costs and repairs but is economically manufactured because of the small number of parts as compared to the devices that require rings, seals, valves and attendant operating components. The apparatus of the invention also achieves improved economy of performance and maintenance because of the rolling action of the rollers themselves which seal the chamber and require no lubrication of the wall or cavity surfaces. Further, because of the reduction of individual parts in the apparatus, and because the chamber itself is defined between two end plates and the rollers, reduction in weight by eliminating engine blocks and the like can be achieved. These as well as other advantages will be evident from the following detailed description.

DETAILED DESCRIPTION OF THE INVENTION

Figure 1:
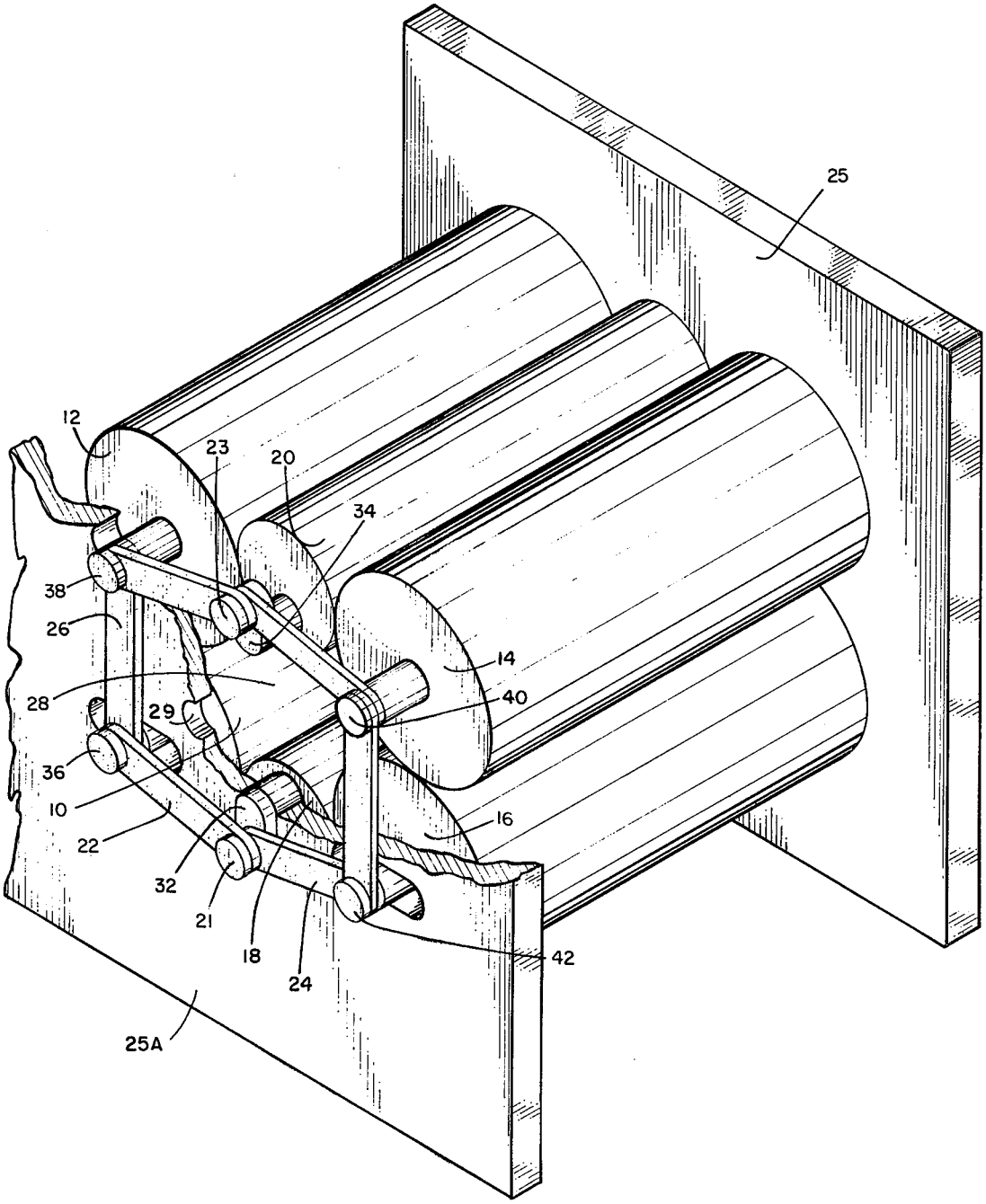
FIG. 1 is a perspective view illustrating the rollers of the apparatus of the invention.
Figure 2:
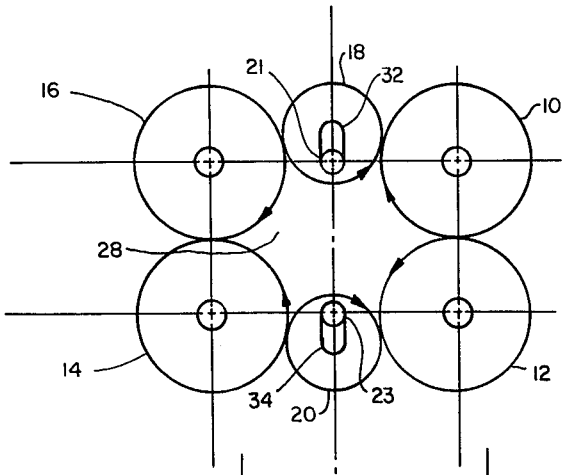
FIGS. 2–5 are views showing different positions of the rollers shown in FIG. 1 and the different chamber sizes achieved by rotating the rollers successively 90°.

Referring to FIGS. 1 and 2, six cylindrical rollers 10, 12, 14, 16, 18 and 20, are mounted on respective axes around which they rotate. Each roller has a substantially cylindrical exterior roller surface, with each cylinder having a uniform diameter along the entire cylinder length. Although the cylinders may be of different respective diameters and lengths, in any apparatus they are preferably all of the same length and are mounted in the apparatus so as to be in contact substantially along their respective lengths. In the arrangement illustrated, each cylinder contacts two adjacent cylinders. Moreover, the cylinders are also secured in the apparatus so that the contact along the cylindrical exterior surfaces is firm and positive whereby a seal is formed along the entire contacting surfaces of the respective cylinders. In this manner, chamber 28 formed and defined between the six rollers is sealed from exterior communication along the roller surfaces.

In the embodiment illustrated in FIG. 1, and also shown in FIGS. 2–5, corner rollers 10, 12, 14 and 16 rotate about centered axles which extend longitudinally through each cylinder, and on which axles the respective rollers rotate. Thus, rollers 10, 12, 14, and 16 rotate about axles 36, 38, 40 and 42 respectively. Rollers 18 and 20 rotate excentrically and incorporate crank means. Accordingly, for roller 18, crankshaft 32 is rotated and is mounted with the roller, while crank arm 21 is centered along the true center of that roller. Similarly, crank means associated with eccentric roller 20 includes crankshaft 34 and crank arm 23. In operation, as crankshafts 32 and 34 are rotated or turned by drive means, not shown, rotation of these crankshafts causes the respective rollers to rotate about eccentric axes.

Figure 3:
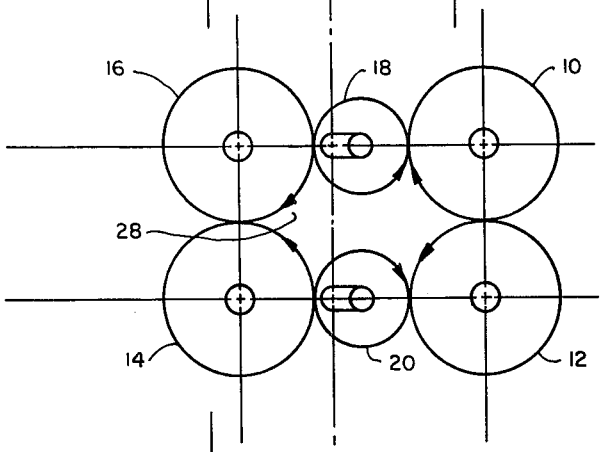
Figure 4:
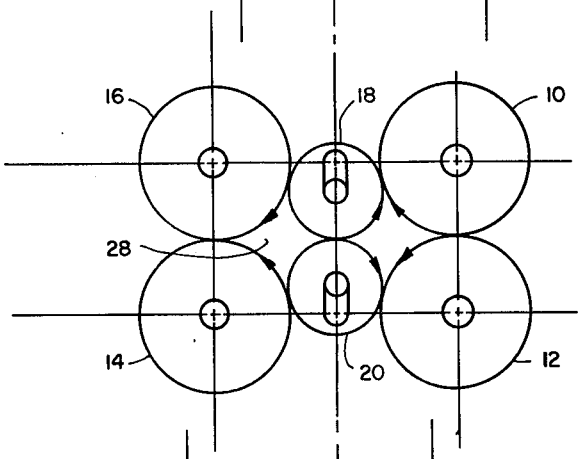
Figure 5:
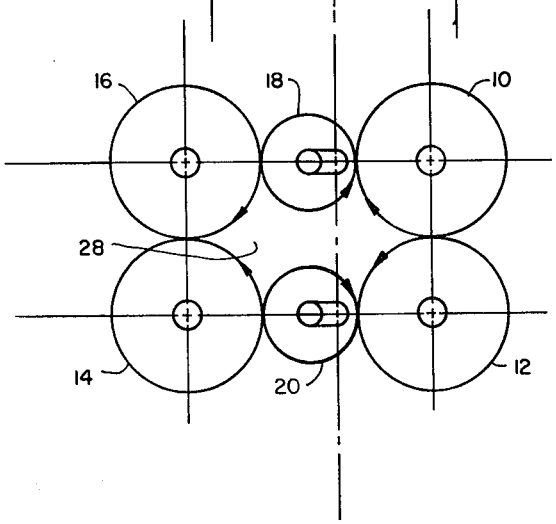

As the centrally located and eccentrically moving rollers 18 and 20 are rotated about their respective crankshafts these rollers alternately move closer and further away from one another as is illustrated in FIGS. 2–5. In the position shown in FIG. 4, the eccentric rollers 18 and 20 are at their nearest or closest relative positions thereby contracting chamber 28 to its smallest volume. In FIG. 3, rollers 18 and 20 have been rotated 90° from the position shown in FIG. 2, and thus the chamber volume has been incrased or expanded. In FIG. 2, rollers 18 and 20 have been rotated another 90° thereby expanding chamber 28 to its greatest volume. In FIG. 5, the center rollers have been rotated an additional 90° whereby the chamber shown is identical to the volume illustrated in FIG. 3.

As the center or smaller and eccentrically rotating rollers are moved, the end rollers, each of which is in contact with another end roller and one of the eccentric rollers, are rotated, and also caused to move laterally, because of the eccentric center roller displacement. Thus, observing FIGS. 2 and 3, as the ecccentric rollers 18 and 20 are moved so as to rotate in the direction shown by the arrows, this lateral movement of all of the rollers is illustrated between FIGS. 2 and 3, with the lateral roller movement being the distance between the center of the crank arm and the center of the crankshaft. Similarly, this lateral movement is noted by observing the displacement of the rollers between FIGS. 4 and 5.

As previously indicated, the rolling contact between adjacent rollers forms a continuous seal along the entire length of the rollers in order to confine and define the interior chamber. Thus, there is no need for any additional chamber walls between the rollers. However, end plates are required at the ends of the rollers, one end plate 25 being illustrated in FIG. 1, with the opposite end plate 25A being partially cut away. The end plates each incorporate slots or ports one of which, 29, appears in end plate 25A communicating between the exterior and chamber 28. The end plates 25 and 25A also include additional slots or ports through which the ends of the roller axles or extensions thereof will extend. The end plates 25 and 25A may incorporate suitable bearings to reduce friction with the rotating axle ends as well as to maintain the respective axles firmly in position. In addition, connecting arms or linkages between the rollers are desirable in order to maintain firm contact between the rollers to insure positive sealing therebetween. These arms are illustrated in FIG. 1, with arms 22 connecting axle 36 of roller 10 with crank arm 21 of roller 18. Similarly, connecting arm 24 extends between the crank arm 21 and axle 42 of roller 16. Another connecting arm 26 between corner rollers 10 and 12 is illustrated, as is an opposite identical arm for maintaining continuous rolling engagement between the respective pairs of corner rollers.

Figure 6:
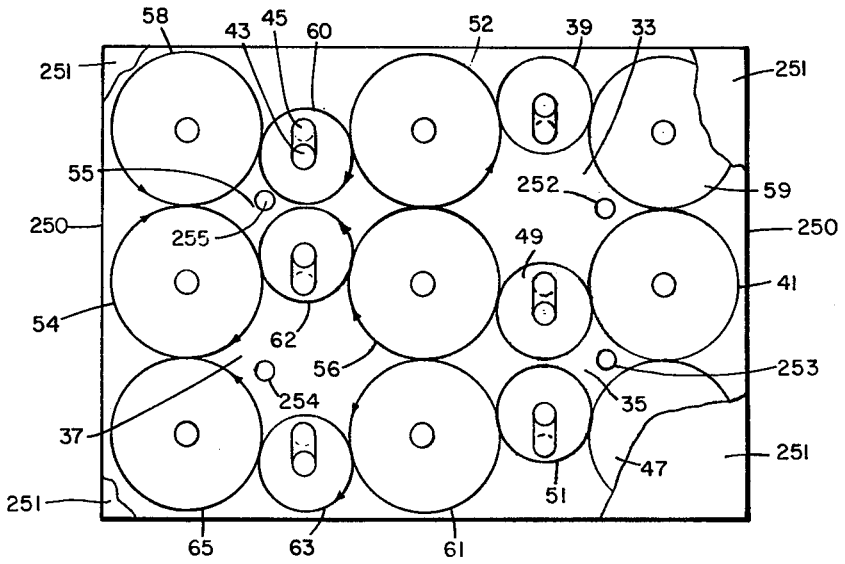
FIG. 6 is a view showing an arrangement of cylindrical rollers combined to achieve four expanding and contracting chambers.

FIG. 6 illustrates a further embodiment of the roller configuration using a combination of rollers to achieve a plurality of expanding and contracting chambers defined by the rollers and end walls 250 and 251 the latter of which is shown broken away for clarity. The combination of rollers has a similar configuration to the basic six roller embodiments illustrated in FIGS. 1–5 with the additional rollers cooperating to form a plurality of chambers. In the embodiment shown, the apparatus functions so that adjacent chambers separated by reciprocating or eccentric rollers oppose one another. Thus, chamber 55 is contracted as chamber 37 is expanded in the view shown. Similarly, chambers 33 and 35 oppose one another as the three rollers 39, 49 and 51 operate. Ports 252, 253, 254 and 255 communicate between the exterior and chambers 33, 35, 37 and 55 respectively. The apparatus may be designed to function in the same manner as that previously described whereby the interior or smaller rollers illustrated rotate eccentrically utilizing a simple crank, and whereby the larger corner rollers will be displaced laterally.

As shown, crankshaft 45 is joined into roller 60, with crank arm 43 centered along the true center of the roller. As the crankshaft rotates, crank arm 43 and roller 60 are caused to rotate eccentrically. This drive results in continuous eccentric movement of the smaller diameter roller. Each of the smaller cylinders or rollers within the apparatus are substantially identical so that discussion hereof is intended to be applicable to the additional small rollers. Rollers 60 and 62, which are adjacent and opposing, will be synchronized so as to rotate at identical speeds, and will move eccentrically and oppositely at the same time. Thus, rollers 60 and 62 will move toward one another simultaneously whereby chamber 55 is contracted, until they are closest, as shown, and thereafter the motion is reversed whereby chamber 55 is expanded. It will be understood that at the time when the eccentric rollers are closest to one another, they will not contact.

Roller 63 also moves toward and away from roller 62, and is synchronized so that it opposes the identical eccentric movement including rotational speed with roller 62, thereby alternately contracting and expanding chamber 37. In this fashion, chambers 37 and 55 are opposing, and as one is at its maximum volume, the other is at its minimum, and vice versa. Similarly, rollers 39, 49 and 51 reciprocate so that chambers 33 and 35 are opposed. Although the rotational speed of all of the smaller rollers must be substantially identical, since each of these reciprocating rollers also contacts two adjacent larger rollers, this precise rotational synchronization is required because of larger rollers 52, 56 and 61 being in continuous rolling engagement with different sets of reciprocating rollers. However, in the manner illustrated, the synchronization of chamber sizes on each side of the apparatus is not required, although it may be desired. For example, the volume of chambers 33 and 35 may be quite independent and different from chambers 37 and 55.

As previously mentioned, where a compound crank means is used so that the small diameter rollers are displaced reciprocally rather than eccentrically, as they rotate, regardless of the small roller synchronization, because of the reciprocating motion and without eccentric motion, the lateral movement of the larger corner rollers will be quite small. This, in such apparatus, rollers 52, 56 and 61 may be positioned with their respective axes or axles around which they rotate in a stationary position, and aligned along a single plane. The rollers on each side may then move laterally only engough so as to allow for the slight difference between the distances between those end rollers and the center rollers to compensate for reciprocating motion of the smaller rollers. Connecting arms or linkages between the rollers in a manner illustrated in FIG. 1 but expanded to include the additional rollers of FIG. 6 will be useful for urging the rollers as previously described in order to maintain continuous rolling and sealing engagement therebetween.

Although the apparatus illustrated in FIG. 6 defines 4 alternately expanding and contracting chambers, it will be understood that combinations of rollers may be used to achieve any desired number of chambers, again with the number of rollers being an even number, and preferably where pairs of reciprocating or eccentrically rotating rollers are opposed in a mirror image manner with respect to the center of the chamber defined between them. Accordingly, any number of rollers may be combined to achieve any desired number of chambers, depending upon the use and requirements of the apparatus so designed. Moreover, the relative sizes of the rollers is not so important, and that shown is by way of illustration only. Thus, the reciprocating or eccentrically rotating rollers may be the same size or larger than the corner rollers, and even opposing rollers may be of different sizes, so long as the full and continuous rotation and sealing between adjacent roller surfaces is maintained without slippage which would thereby otherwise alter the advantages of the invention.

Figure 7:
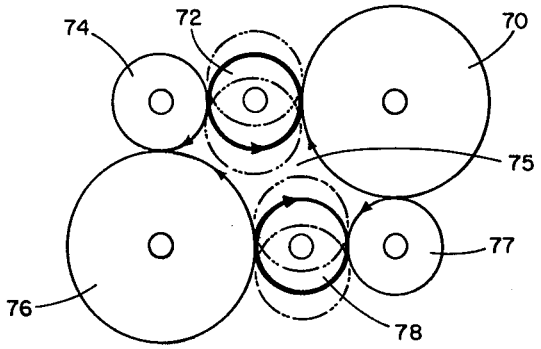
FIG. 7 is a view of still another arrangement of cylindrical rollers combined to form an alternately expanding and contracting chamber.

FIG. 7 illustrates an alternative arrangement of rollers, with large rollers 70 and 76 and small rollers 77 and 74 acting as corner rollers between which reciprocating or eccentric 72 and 78 are positioned. Where the rollers move eccentrically in the manner described regarding FIGS. 1–5, the corner rollers must be displaced laterally to allow for the eccentric roller motion while continuous and full sealing and rolling engagement is realized. If desired, the rollers 72 and 78 may instead incorporate compound crank means for achieving reciprocating motion in the manner described regarding FIG. 6, or by means of similar purpose, in which case the roller movement will be that illustrated generally by the phantom or dotted lines as chamber 75 is alternately expanded and contracted. Again, it will be evident that the reciprocating or eccentric rollers must be synchronized to achieve opposite and equal motion alternately toward and away from one another. Moreover, connecting arms are used between the rollers in order to maintain the full sealing and rolling engagement between the rollers.

Figure 8:
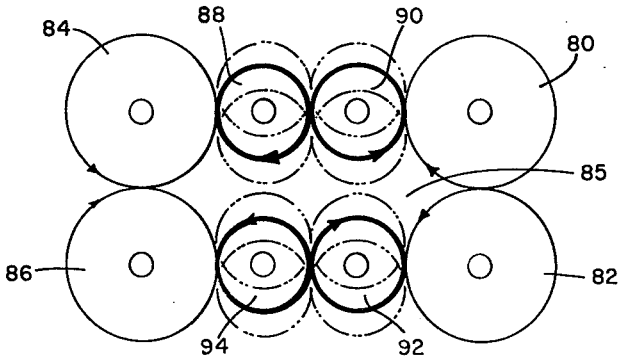
FIG. 8 illustrates an apparatus having two pair of reciprocating rollers for expanding and contracting a chamber according to the invention.

FIG. 8 illustrates still another embodiment in which two pairs of reciprocating interior rollers are used for alternately expanding and contracting chamber 85. Accordingly, reciprocating rollers 88 and 90 are opposed to rollers 92 and 94, these rollers being synchronized in their rotational motion so that crank means will cause the roller pair 88 and 90 to moe precisely oppositely of the roller pair 92 and 94. Again, where compound crank motion means is incorporated in the rollers for reciprocation, lateral movement of the end rollers 80, 82, 84 and 86 will be minimal, enough only to provide for distance changes between end rollers caused by the reciprocating roller movement. Further, the various sizes of the rollers may be varied as desired, to achieve the proper functioning of the apparatus.

Figure 9:
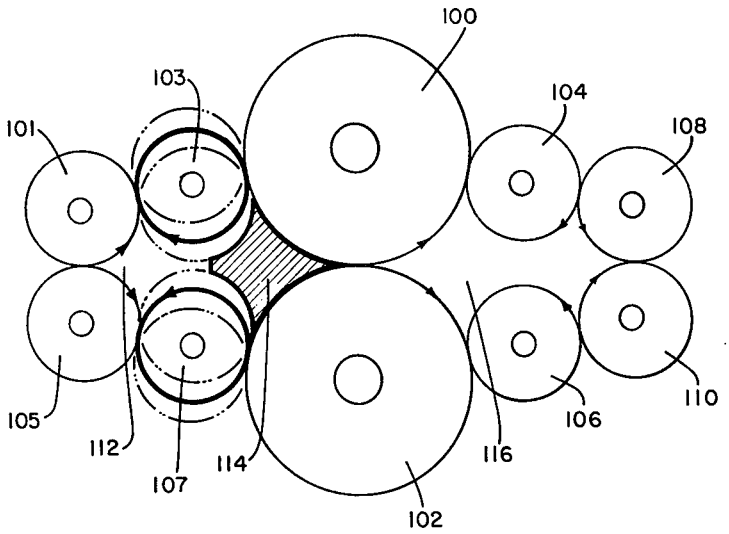
FIG. 9 is a view of another arrangement of cylindrical rollers to form a pair of chambers according to the invention.

FIG. 9 illustrates still another roller arrangement in which larger rollers 100 and 102 rotate about stationary axes whereas end rollers 108 and 110 on one side of the apparatus and 101 and 105 will be moved laterally to any extent required for the reciprocation motion of the interior rollers. Chamber 114 is alternately expanded and contracted due to the reciprocating motion of the rollers 103 and 107 while chamber 116 is expanded or contracted as rollers 104 and 106 similarly operate. These reciprocating and rotating rollers may be syncronized so that the chamber will have the same identical volumes at any given time, or so that they will be expanded or contracted oppositely. Also illustrated is a chamber volume reducing member 114, which can be used in any of the described apparatus described within the scope of the invention in order to fill any portion of any chamber desired. Thus, such a means may be used where advantage is to be gained by further decreasing the overall volume of the chamber rather than taking full advantage of the entire expandable chamber size.

Figure 10:
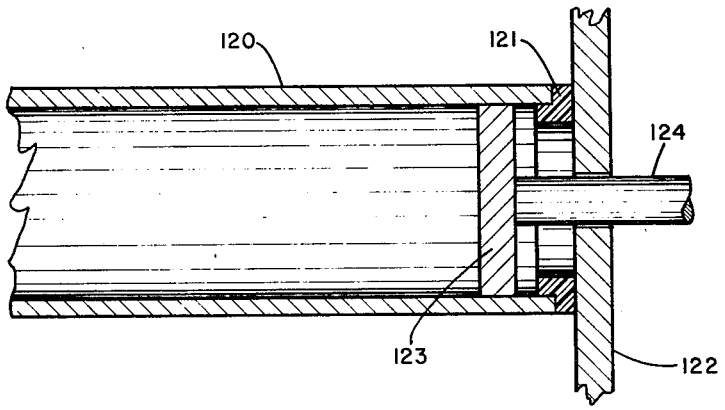
FIG. 10 is a partial sectional elevation showing roller sealing means.

FIG. 10 illustrates a means for sealing the roller ends with the end panels or plates as previously noted. In a preferred embodiment, the rollers are hollow, in the form of cylindrical shells, with the axles or crank arms journaled into suitable recessed end plates in the respective rollers. In the example illustrated, roller 120 is hollow, and has a recessed end plate 123 into which a centered axle 124 is journaled. At the cylinder end is secured a sealing ring 121, which ring engages the exposed interior surface of end plate 122 thereby sealing off the cavity. As the roller is rotated, the sealing ring continuously engages the polished interior end surface, whether the roller motion is eccentric or reciprocal as previously described.

The material of the rollers may be rigid including metal or rigid plastics, or may be more flexible such as flexible and compressible plastics or elastomers. The specific material comprising the rollers will depend on the use of the apparatus, the material requirements being only such that the rollers will function properly and adequately, with the specific material being selected to meet the necessary functional apparatus requirements including resistance to withstand chamber environments to which exposed. Similarly, the material used for sealing the roller ends may be selected to meet apparatus requirements including friction reduction and wear resistance, since the seals will be in continuous sliding engagement with the interior and plate surface.

The orientation of the rollers in the apparatus is not particularly critical, unless specific use requirements dictate such orientation. Thus, for example, the rollers may rotate along horizontal or vertical axes, or any other angle. Accordingly, the views shown may be side elevational views or top plan views, with the concept of and operation of the apparatus otherwise being substantially identical, regardless of how the cylindrical rollers or the housing or end plates are oriented.

From the description, it will be noted that the apparatus may be used to perform work, where rollers are driven by steam, as in a Rankine engine, hot gas, as in a Stirling engine, or in commonly used internal combustion engine cycling, with proper inlet and outlet ports formed in desired rollers and which will be aligned with corresponding ports in the respective end plates or by other valve means, to achieve two or four cycle operation. Again cylinder or roller circumferences or diameters are not particularly critical, except where proper sequence for alignment of ports is desired or required as previously explained.

The advantages of the apparatus of the invention, as previously explained, include the obviation of lubrication of wall surfaces surrounding the expanding and contracting chambers because of the rolling action of the rollers which produce minimum friction. Moreover, chamber sizes are easily adjusted to create desired power output, and the components are readily interchangeable. Engine torque may be determined by the location and dimension of a single part, i.e., the eccentric power output shaft, and forces of combustion are distributed over a large and changing area of cylinder walls and through a multiplicity of shafts and connecting arm bearings, rather than through one piston, one wrist pin bearing and a single crankshaft bearing. Moreover, rotating parts which form the working chamber in an internal combustion or heat engine embodiment are exposed to a cooling medium over the entire cylinder wall surfaces during each revolution. Thus, only a portion of the cylinder or roller walls are exposed to the heat and forces continually throughout the entire cycle since the heated roller areas are continually proceeding to a cooling medium. As use results in engine wear, adjustment of external connecting arm bearing tension will maintain seal integrity without disassembly of major engine components. Moreover, continued operation may cause the common roller surfaces to machine themselves to a progressively more compatible fit. Because of the light weight and low mechanical mass of reciprocating parts (rollers), higher rotational speeds are possible. Further, the chamber sizes may be adjusted by simply varying dimensions of the eccentric or reciprocating roller crank or by the insertion or deletion of volume reducing members as previously described. These as well as other advantages and equivalent embodiments within the purview of the invention as described herein will be evident to those skilled in the art.

I claim:

1. An apparatus having at least one alternately expanding and contracting chamber comprising a pair of parallel end plates; a plurality of cylindrical rollers each having their axes parallel to each other, normal to said end plates and in sealing engagement at their ends with the respective adjacent surface of said end plates; each of said rollers having an exterior surface in rolling engagement with two adjacent rollers, said rollers defining with said end plates an enclosed chamber; and wherein at least one of the rollers rotates about an axis eccentric with respect to the axis of said roller to move reciprocally into and out of the chamber formed by said rollers and said end plates, and means communicating between said chamber and the exterior thereof.

2. Apparatus of claim 1 wherein said rollers are elongated, and of substantially equal lengths whereby said rollers are in contact with the adjacent rollers substantially along their entire lengths, respectively.

3. The apparatus of claim 2 including axles on which said rollers rotate and means connecting the ends of said axles urging said rollers to maintain constant surface engagement for sealing said chamber.

4. The apparatus of claim 3 comprising six of said rollers.

5. An apparatus having at least one alternately expanding and contracting chamber comprising a plurality of at least six cylindrical rollers each of which has an exterior surface in rolling engagement with two adjacent rollers, said rollers being rotatable along parallel axes, wherein at least one of the rollers rotates about a reciprocating axis; a pair of end plates in sealing engagement with opposite ends of said rollers to complete said chamber, and means communicating between interior and exterior of said chamber.

6. The apparatus of claim 5 wherein two of said rollers are driven reciprocally and oppositely to alternately expand and contract said chamber.

7. An apparatus having at least one alternately expanding and contracting chamber comprising a pair of parallel end plates; a plurality of cylindrical rollers each having their axes parallel to each other, normal to said end plates and in sealing engagement at their ends with the respective adjacent surface of said end plates, each of said rollers having an exterior surface in rolling engagement with two adjacent rollers, and wherein at least one of the rollers rotates about an axis eccentric with respect to the axis of said roller to move reciprocally into and out of the chamber formed by said rollers and said end plates, and means communicating between said chamber and the exterior thereof, wherein the plurality of rollers comprises six of said rollers, wherein the first and second rollers rotate about eccentric axes, said third, fourth, fifth and sixth rollers each rotate about axes which are movable laterally along parallel planes, said first roller being located between said third and fourth rollers and in contact therewith, said second roller being located between said fifth and sixth rollers and in contact therewith, and whereby said third and fifth rollers are in contact and said fourth and sixth rollers are in contact.

8. The apparatus of claim 7 wherein said first and second rollers are opposite and move toward and away from each other without making contact to alternately contract and expand said chambers respectively.

9. The apparatus of claim 8 wherein said third and fourth roller axes move laterally and reciprocally along a common first plane, and said fifth and sixth roller axes move laterally and reciprocally along a common second plane, parallel with said first plane.

10. The apparatus of claim 9 wherein the diameters of said first and second rollers are substantially identical and the diameters of said third, fourth, fifth and sixth rollers are substantially and different from said first and second rollers.

11. The apparatus of claim 10 wherein the diameter of said first and second rollers is smaller than the diameter of said third, fourth, fifth and sixth rollers.

12. The apparatus of claim 7 comprising multiples of said expanding and contracting chambers each of which is defined between four corner rollers each rotatable about axes which are movable laterally along parallel planes and two opposed intermediate rollers each located between first and second pair of said corner rollers both rotatable about eccentric axes, said first and second roller pairs being movable along different and parallel planes.

13. The apparatus of claim 12 comprising at least three pairs of said corner rollers and three of said intermediate rollers and which define two of said chambers.

14. The apparatus of claim 13 wherein the diameter of said corner rollers are substantially identical and the diameter of said intermediate rollers are substantially identical and smaller than the diameter of said corner rollers.

* * * * *